US005924246A

United States Patent [19]

Jurgens et al.

[11] Patent Number: 5,924,246

[45] Date of Patent: Jul. 20, 1999

[54] HANGER CLIP SYSTEM FOR USE WITH SUSPENDED CEILINGS

[75] Inventors: David C. Jurgens, Chicago, Ill.; Charles G. Vaughn, Dobbs Ferry, N.Y.

[73] Assignee: ES Holdings Company, New York, N.Y.

[21] Appl. No.: 08/841,130

[22] Filed: Apr. 29, 1997

Related U.S. Application Data

[60] Provisional application No. 60/016,501, Apr. 30, 1996.

[51] Int. Cl.[6] ..... G09F 7/18

[52] U.S. Cl. ..... 52/39; 40/617; 52/38; 52/712; 248/317; 248/343

[58] Field of Search ..... 40/617; 52/27, 52/38, 39, 712, 714, 656.9; 248/317, 328, 342, 343; 403/295, 298

[56] References Cited

U.S. PATENT DOCUMENTS

| | | | |
|---|---|---|---|
| 319,280 | 6/1885 | Lodge . | |
| D. 353,992 | 1/1995 | Dombrowski et al. . | |
| D. 367,389 | 2/1996 | Cole et al. . | |
| 670,552 | 3/1901 | Brown . | |
| 1,139,908 | 5/1915 | Salkeld . | |
| 1,633,344 | 6/1927 | Moran | 248/328 |
| 1,745,858 | 2/1930 | McCarty | 52/714 |
| 1,889,077 | 11/1932 | Russell . | |
| 2,513,759 | 7/1950 | Tarallo . | |
| 2,817,847 | 12/1957 | Spencer | 248/328 X |
| 3,327,376 | 6/1967 | Freeman et al. . | |
| 3,530,545 | 9/1970 | Lengyl . | |
| 3,601,862 | 8/1971 | Hargadon . | |
| 3,743,228 | 7/1973 | Drab . | |
| 3,831,338 | 8/1974 | Klingensmith et al. | 52/656.9 X |
| 3,936,913 | 2/1976 | Weissman . | |
| 3,952,985 | 4/1976 | Davenport | 248/317 |
| 4,065,090 | 12/1977 | Mauney . | |
| 4,074,885 | 2/1978 | Hacker . | |
| 4,135,692 | 1/1979 | Ferguson . | |
| 4,223,488 | 9/1980 | Schoenung . | |
| 4,318,525 | 3/1982 | Welch . | |
| 4,667,913 | 5/1987 | Peele et al. . | |
| 4,830,199 | 5/1989 | Wolfe et al. . | |
| 5,022,173 | 6/1991 | Pfeiffer . | |
| 5,152,117 | 10/1992 | Wynar | 52/712 |
| 5,425,519 | 6/1995 | Hudert . | |
| 5,480,116 | 1/1996 | Callas . | |
| 5,482,242 | 1/1996 | Jergelius | 248/328 |
| 5,490,651 | 2/1996 | Kump . | |

*Primary Examiner*—Carl D. Friedman
*Assistant Examiner*—Timothy B. Kang
*Attorney, Agent, or Firm*—Jones, Day, Reavis & Pogue

[57] ABSTRACT

A merchandising display hanger is disclosed which includes a central portion, a portion extending downwardly from the central portion and a portion extending upwardly from the central portion. The said downwardly extending portion has a central aperture for receiving and positioning a hook to suspend a merchandising display and a pair of opposed cut-out regions to enable a cord connected to the assembly to be wrapped laterally around the assembly for purposes of storage.

19 Claims, 2 Drawing Sheets

HANGER CLIP SYSTEM FOR USE WITH SUSPENDED CEILINGS

This is application claims the benefit of U.S. Provisional Application No. 60/016,501, filed Apr. 30, 1996.

BACKGROUND OF THE INVENTION

1. Field of the Invention

The present invention relates generally to a hanger clip system for use with suspended ceilings and more particularly to a clip which can be easily installed on a suspended ceiling to provide a means for conveniently hanging display articles for merchandising purposes.

2. Description of the Prior Art

In many commercial retail establishments it is common to find product advertising or other point of purchase displays used for promotional purposes. Such articles are often intended to be used only temporarily and not as permanent fixtures. Accordingly, they are frequently constructed of lightweight materials such as chip board, paper, foam or even as plastic inflatable articles. These articles can be designed to be free standing or hanging devices. In one common form, display devices are designed to be suspended from the ceiling of the surrounding room where they are out of reach by the establishment's customers but are readily visible.

A typical commercial establishment is constructed with relatively high ceilings and often the ceilings are of a type known as a drop or suspended ceiling. This type of ceiling permits the commercial space to be built out with many of its mechanical systems such as heating, ventilating and air conditioning, electrical, communications, fire protection and the like to be installed overhead and concealed by the suspended ceiling. A common design of a suspended ceiling includes a series of metal T-bars connected together in a regular geometric grid and suspended by simple wire hangers over the room space. The grid is preconfigured to receive certain standard sized ceiling panels which may be decorated in a variety of ways. One such panel is a lightweight fiberglass panel covered with a textured plastic laminate. The T-bars are inverted to define opposed flanges on which the panels rest by gravity. An advantage of these ceilings is that the panels can be manually removed without tools if access to the overhead mechanical systems is desired.

Because they are generally lightweight in construction, merchandising displays can be readily hung from T-bars of a suspended ceiling system. Accordingly, attempts have been made to design fastening systems of some type which can be conveniently installed on a T-bar to hang a display. For example, a hook of some sort may be used to suspend a suitable cord with the hook engaging a flange of the T-bar. However, a disadvantage of such a system is that the hook could be too easily detached from the T-bar causing the associated display to fall from the ceiling. Further, most ceilings are of such a height that a ladder would be needed to install such a hook on a typical suspended ceiling.

Accordingly, it is desirable to provide a hanger clip for use with suspended ceilings which can adequately support a typical merchandising display with a positive means for locking the clip to the ceiling. It is further desirable to provide such a clip which can be installed with relative ease and without the need for the installer to use a ladder or other elevating means. Still further, it is desirable to provide such a hanger clip which can readily be supplied with a suitable, conveniently useable tether cord for hanging a display and wherein the tether cord can be quickly adjusted to proper length and positively secured.

SUMMARY OF THE INVENTION

The present invention provides a merchandising display hanger which is constructed as a unitary clip assembly including a generally planar, horizontally disposed central portion; a first generally planar portion extending downwardly from the central portion and a second generally planar portion extending upwardly from the central portion. The first portion of the assembly includes a central aperture structured and dimensioned to receive and position a hook for suspending a merchandising display. The first portion also includes a pair of opposed cut-out regions arranged about-its periphery and the cut-outs are structured and dimensioned to enable a cord connected to the assembly to be wrapped laterally about the first portion for storage.

In the present merchandising display hangers, the first portion of the assembly preferably extends downwardly at an essentially right angle from the central portion and the second portion extends upwardly at an essentially right angle from the central portion. In addition, the central aperture formed in the first portion preferably includes a V-shaped lower edge to accommodate a hook arrangement and slots are formed in the first portion to enable a cord to be cinched thereto. Furthermore, the present merchandising display hangers preferably include at least one hole formed in the first portion enabling connection of a cord to the first portion.

In an alternative embodiment of the invention, the hangers may also including a pair of opposed cut-out regions arranged about the periphery of the central portion which are structured and dimensioned to enable a cord connected to the assembly to be wrapped laterally about the central portion and at least one hole may be formed in the central portion to enable connection of a cord to the central portion. Additionally, slots may be formed in the central portion to enable a cord to be cinched to the central portion of the assembly.

Also, this invention includes the provision of an installation tool for effective and efficient installation of the merchandising display hangers of this invention and to the provision of elements on the hangers for expediting the interconnection of the hangers with the installation tool including opposed ribs formed in the first portion of the assembly.

BRIEF DESCRIPTION OF THE DRAWINGS

The present invention will be understood upon a reading of the following detailed description taken in conjunction with the accompanying drawings wherein.

DETAILED DESCRIPTION OF THE PREFERRED EMBODIMENT

Figure 1:
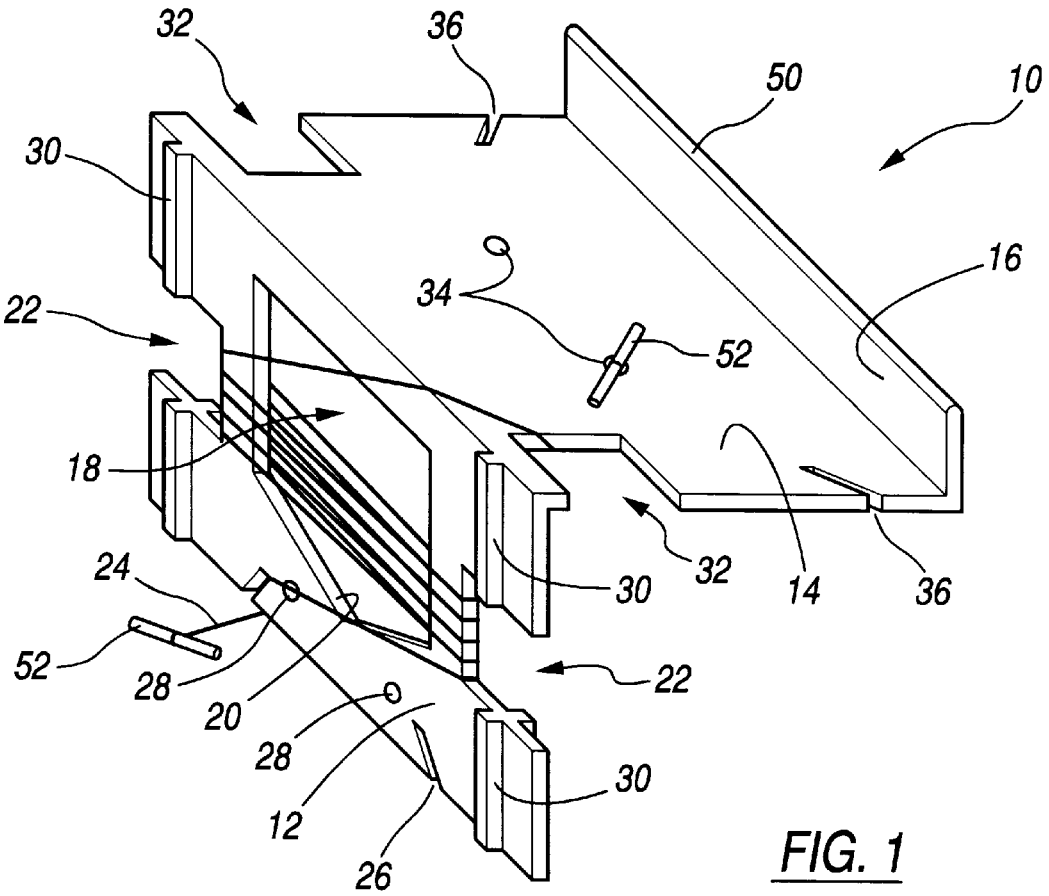
FIG. 1 is a perspective view of a display hanger clip constructed in accordance with the principles of the invention.
Figure 2:
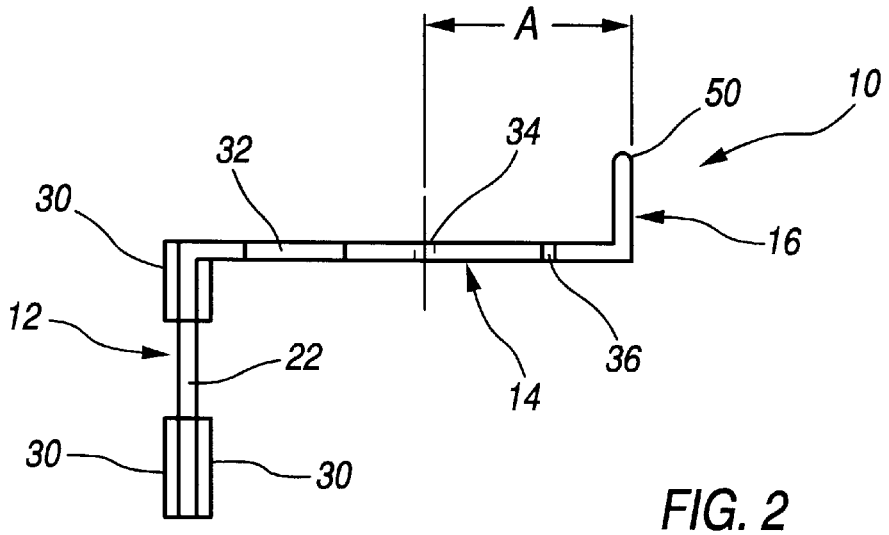
FIG. 2 is a side elevational view thereof.

Referring now to the drawings and initially to FIGS. 1 and 2, a clip for use as a merchandising display hanger is designated generally by the reference numeral 10. The clip 10 may be formed from any relatively rigid material such as metal or molded plastic and generally has a first planar portion 12 extending at right angles from a second central planar portion 14 with a third planar portion 16 extending at right angles from the central portion 14.

The first planar portion 12 is preferably formed with a large central aperture 18 having a V-shaped lower edge 20. This aperture 18 may thereby serve to receive and position a suitable hook if it is desired to suspend an article from a hook attached to the hanger 10. Portion 12 also is formed with a pair of opposed cut-outs 22 which permit convenient storage of a cord 24, wrapped around the portion 12. Suitable wedge-shaped slots 26 may be provided to cinch the cord 24 to the hanger clip 10. Also, holes 28 may be provided through which the cord 24 may be passed to provide a point from which a desired display may hang. Opposed ribs 30 may be provided for purposes which will be explained hereinafter.

The central portion 14 of the clip 10 may have cut-outs 32 similar to the cut-outs 22 around which the cord 24 may be wrapped if desired. Also, holes 34 are preferably provided through which the cord 24 may be passed. Slots 36 configured like slots 26 provide a means for cinching the cord 24 to the portion 14.

Figure 3:
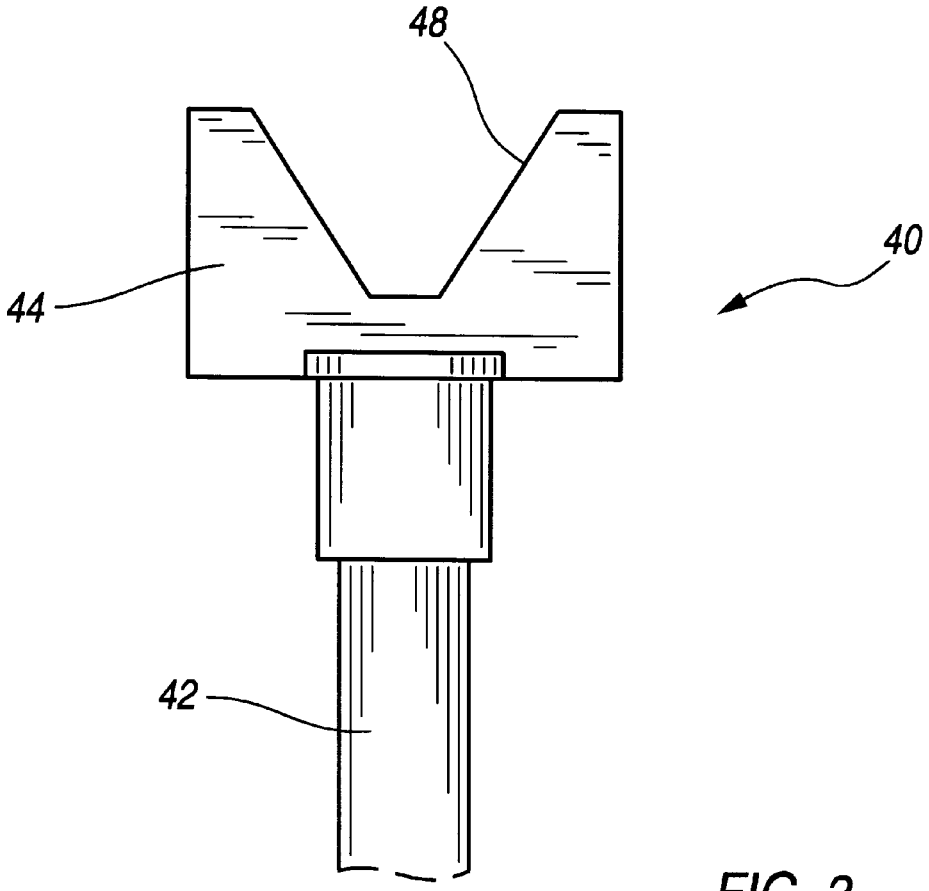
FIG. 3 is a side view of a tool for installing the clip on a suspended ceiling system.
Figure 4:
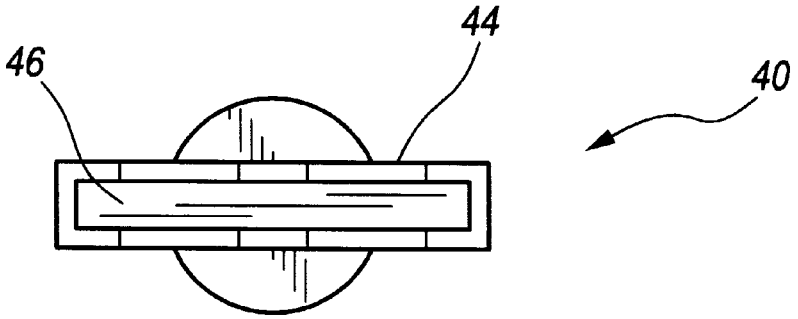
FIG. 4 is an end view of the tool.

Turning now to FIGS. 3 and 4, a tool suitable for installing the hanger clip 10 on a suspended ceiling is designated generally by the reference numeral 40. The tool 40 includes a pole 42 and a fixture 44 which is preferably threadedly received on the pole 42. The fixture 44 is configured generally as a cup having an internal recess 46 which is dimensioned and configured to slidingly receive the planar portion 12 of a hanger clip 10. The fixture 44 has a large V-shaped cut-out 48 which permits the cord 24 of the clip 10 to extend freely from the clip 10 when the clip 10 is fully inserted into the recess 46 of the fixture 44.

It can now be appreciated that the clip 10 of the present invention permits a merchandising display or sign to be hung from a suspended ceiling in a highly convenient and effective manner. To install the clip 10, planar portion 12 of the clip 10 is simply inserted into the recess 46 of the pole fixture 44. The ribs 30 of the portion 12 assure that the clip 10 is properly stabilized in the fixture 44. Then, by grasping the pole 42, the clip 10 may be elevated without the need for a ladder or the like to the ceiling at a desired point adjacent to a T-bar. By pushing the clip 10 up against the ceiling panel, the clip 10 can then be positioned such that the central portion 14 rests on the flange of the T-bar with the clip portion 16 moved into contact with the vertical strut member of the T-bar. The ceiling panel will then come to rest on the central portion 14 of the clip 10 and the edge of the panel will engage the clip portion 16 trapping the clip 10 in seated position on the T-bar. Preferably, edge 50 of the portion 16 is rounded so that the clip 10 does not scrape and damage the ceiling panel when the clip 10 is installed.

It can further be appreciated that the clip 10 is highly versatile for hanging displays of various types. The cord 24 may be unwrapped to any suitable length and threaded through any one of the holes 28 or 34. Barbs 52 crimped to the ends of the cord 24 prevent withdrawal of the cord 24 through the holes 28 and 34. Of course, the cord 24 may also be conveniently tied-off by simply cinching it in a desired slot 26 or 36. An important feature of the clip 10 is that the holes 34 are spaced from the clip portion 16 by a distance approximately equal to the width of a standard T-bar flange. Typically, this dimension as measured at A in FIG. 2 is on the order of approximately one-half inch. By so positioning these holes 34, the cord 24 may be threaded through such holes 34 as to hang a display from just slightly off the edge of the T-bar flange thereby minimizing the moment arm length which would tend to twist the clip 10 out of its seated position on the T-bar under the weight of a display. Of course, to remove the clip 10, the ceiling panel is simply raised slightly at the clip 10 and the clip 10 will merely fall off the T-bar.

We claim:

1. A merchandising display hanger comprising a unitary clip assembly including:

a) a generally planar, horizontally disposed central portion;

b) a first generally planar portion extending downwardly from the central portion, said first portion including:

b1) a central aperture structured and dimensioned to receive and position a hook for suspending a merchandising display; and b2) a pair of cut-out regions formed in opposite side edges of the first portion and being structured and dimensioned to enable a cord connected to the assembly to be wrapped laterally about the first portion for storage thereof; and c) a second generally planar portion extending upwardly from the central portion.

2. The merchandising display hanger of claim 1 wherein the first portion extends downwardly at an essentially right angle from the central portion.

3. The merchandising display hanger of claim 1 wherein the second portion extends upwardly at an essentially right angle from the central portion.

4. The merchandising display hanger of claim 1 including opposed ribs formed in the first portion enabling interconnection of the assembly with an installation tool.

5. The merchandising display hanger of claim 1 including at least one hole formed in the central portion enabling connection of a cord to the central portion of the assembly.

6. A merchandising display hanger comprising a unitary clip assembly including:

a) a generally planar, horizontally disposed central portion;

b) a first generally planar portion extending downwardly from the central portion, said first portion including:

b1) a central aperture structured and dimensioned to receive and position a hook for suspending a merchandising display; and b2) a pair of opposed cut-out regions arranged about the periphery of the first portion and being structured and dimensioned to enable a cord connected to the assembly to be wrapped laterally about the first portion for storage thereof;

c) a second generally planar portion extending upwardly from the central portion; and d) the central aperture formed in the first portion having a V-shaped lower edge.

7. A merchandising display hanger comprising a unitary clip assembly including:

a) a generally planar, horizontally disposed central portion;

b) a first generally planar portion extending downwardly from the central portion, said first portion including:

b1) a central aperture structured and dimensioned to receive and position a hook for suspending a merchandising display; and b2) a pair of opposed cut-out regions arranged about the periphery of the first portion and being structured and dimensioned to enable a cord connected to the assembly to be wrapped laterally about the first portion for storage thereof;

c) a second generally planar portion extending upwardly from the central portion; and d) slots formed in the first portion enabling a cord to be cinched to the first portion of the assembly.

8. A merchandising display hanger comprising a unitary clip assembly including:

a) a generally planar, horizontally disposed central portion;

b) a first generally planar portion extending downwardly from the central portion, said first portion including:

b1) a central aperture structured and dimensioned to receive and position a hook for suspending a merchandising display; and b2) a pair of opposed cut-out regions arranged about the periphery of the first portion and being structured and dimensioned to enable a cord connected to the assembly to be wrapped laterally about the first portion for storage thereof;

c) a second generally planar portion extending upwardly from the central portion; and d) at least one hole formed in the first portion enabling connection of a cord to the first portion of the assembly.

9. A merchandising display hanger comprising a unitary clip assembly including:

a) a generally planar, horizontally disposed central portion;

b) a first generally planar portion extending downwardly from the central portion, said first portion including:

b1) a central aperture structured and dimensioned to receive and position a hook for suspending a merchandising display; and b2) a pair of opposed cut-out regions arranged about the periphery of the first portion and being structured and dimensioned to enable a cord connected to the assembly to be wrapped laterally about the first portion for storage thereof;

c) a second generally planar portion extending upwardly from the central portion; and d) a pair of opposed cut-out regions arranged about the periphery of the central portion and being structured and dimensioned to enable a cord connected to the assembly to be wrapped laterally about the central portion.

10. A merchandising display hanger comprising a unitary clip assembly including:

a) a generally planar, horizontally disposed central portion;

b) a first generally planar portion extending downwardly from the central portion, said first portion including:

b1) a central aperture structured and dimensioned to receive and position a hook for suspending a merchandising display; and b2) a pair of opposed cut-out regions arranged about the periphery of the first portion and being structured and dimensioned to enable a cord connected to the assembly to be wrapped laterally about the first portion for storage thereof;

c) a second generally planar portion extending upwardly from the central portion; and d) slots formed in the central portion enabling a cord to be cinched to the central portion of the assembly.

11. A merchandising display hanger comprising a unitary clip assembly including:

a) a generally planar, horizontally disposed central portion;

b) a first generally planar portion extending downwardly at an essentially right angle from the central portion, said first portion including:

b1) a central aperture having a V-shaped lower edge structured and dimensioned to receive and position a hook for suspending a merchandising display; and b2) a pair of opposed cut-out regions arranged about the periphery of the first portion and being structured and dimensioned to enable a cord connected to the assembly to be wrapped laterally about the first portion for storage thereof; and c) a second generally planar portion extending upwardly at an essentially right angle from the central portion.

12. The merchandising display hanger of claim 11 including slots formed in the first portion enabling a cord to be cinched to the first portion of the assembly.

13. The merchandising display hanger of claim 11 including at least one hole formed in the first portion enabling connection of a cord to the first portion of the assembly.

14. The merchandising display hanger of claim 11 including opposed ribs formed in the first portion enabling interconnection of the assembly with an installation tool.

15. The merchandising display hanger of claim 11 including a pair of opposed cut-out regions arranged about the periphery of the central portion and being structured and dimensioned to enable a cord connected to the assembly to be wrapped laterally about the central portion.

16. The merchandising display hanger of claim 11 including at least one hole formed in the central portion enabling connection of a cord to the central portion of the assembly.

17. The merchandising display hanger of claim 11 including slots formed in the central portion enabling a cord to be cinched to the central portion of the assembly.

18. A merchandising display hanger comprising a unitary clip assembly including:

a) a generally planar, horizontally disposed central portion including:

a1) a pair of opposed cut-out regions arranged about the periphery of the central portion and being structured and dimensioned to enable a cord connected to the assembly to be wrapped laterally about the central portion;

a2) slots formed in the central portion enabling a cord to be cinched to the central portion; and a3) at least one hole formed in the central portion enabling connection of a cord to the central portion;

b) a first generally planar portion extending downwardly at an essentially right angle from the central portion, said first portion including:

b1) a central aperture having a V-shaped lower edge structured and dimensioned to receive and position a hook for suspending a merchandising display; and b2) a pair of opposed cut-out regions arranged about the periphery of the first portion and being structured and dimensioned to enable a cord connected to the assembly to be wrapped laterally about the first portion for storage thereof;

b3) slots formed in the first portion enabling a cord to be cinched to the first portion; and b4) at least one hole formed in the first portion enabling connection of a cord to the first portion; and c) a second generally planar portion extending upwardly at an essentially right angle from the central portion.

19. The merchandising display hanger of claim 18 including opposed ribs formed in the first portion enabling interconnection of the assembly with an installation tool.

* * * * *